US006085734A

United States Patent [19]

DeGroot et al.

[11] Patent Number: 6,085,734

[45] Date of Patent: Jul. 11, 2000

[54] FUEL MULTIPLIER TRANSFER FROM DYNAMIC CRANKSHAFT FUELING CONTROL TO OXYGEN SENSOR OPERATION

[75] Inventors: Kenneth P. DeGroot, Macomb Township; Bruce H. Teague, Grosse Pointe Park; Gregory T. Weber, Commerce Township; Jeremy M. Smith, Farmington, all of Mich.

[73] Assignee: Chrysler Corporation, Auburn Hills, Mich.

[21] Appl. No.: 09/211,939

[22] Filed: Dec. 15, 1998

[51] Int. Cl.[7] ..... F02D 41/14

[52] U.S. Cl. ..... 123/696; 123/436

[58] Field of Search ..... 123/436, 672, 123/696; 701/109, 110

[56] References Cited

U.S. PATENT DOCUMENTS

| | | | |
|---|---|---|---|
| 4,780,827 | 10/1988 | Fujimori et al. | 701/110 |
| 5,056,308 | 10/1991 | Kume et al. | 60/276 |
| 5,809,969 | 9/1998 | Fiaschetti et al. | 123/436 |
| 5,901,684 | 5/1999 | Fiaschetti et al. | 123/436 |
| 5,947,088 | 9/1999 | DeGroot et al. | 123/436 |

*Primary Examiner*—Tony M. Argenbright
*Attorney, Agent, or Firm*—Mark P. Calcaterra

[57] ABSTRACT

A method is provided for controlling the delivery of fuel to an engine of an automotive vehicle equipped with a dynamic crankshaft fuel control system and an oxygen sensor feedback based fuel control system. The method includes determining an averaged combustion metric from the dynamic crankshaft fuel control system. The combustion metric is compared to an allowable engine roughness value and a dynamic crankshaft fuel control fuel multiplier is adjusted based on the comparison via a proportional-integral-derivative control calculation. Thereafter, the integral term of the dynamic crankshaft fuel control system's proportional-integral-derivative control calculation is stored. If it is time to switch fuel control from the dynamic crankshaft fuel control system to the oxygen sensor feedback fuel control system, the stored integral term of the dynamic crankshaft fuel control system's fueling multiplier is transferred to the proportional-integral-derivative calculation of the oxygen sensor feedback fuel control system. As such, the last integral term used in determining the fuel multiplier of the dynamic crankshaft fuel control system is used as the first integral term determining the fuel multiplier of in the oxygen sensor feedback fuel control system. As such, the transition from one fuel control system to the other is smoothed.

11 Claims, 3 Drawing Sheets

FUEL MULTIPLIER TRANSFER FROM DYNAMIC CRANKSHAFT FUELING CONTROL TO OXYGEN SENSOR OPERATION

BACKGROUND OF THE INVENTION

1. Technical Field

The present invention generally relates to fuel control systems for automotive vehicles and, more particularly, to a fuel control system for an automotive vehicle equipped with a dynamic crankshaft fuel control system and an oxygen sensor feedback fuel control system.

2. Discussion

Many modern automotive vehicles are equipped with a dynamic crankshaft fuel control system for controlling engine fueling for a brief period of time after start-up. The dynamic crankshaft fuel control system typically leans the fueling during this period to improve emissions. After the dynamic crankshaft fuel control system has completed its task, fuel control is transferred to an oxygen sensor feedback based fuel control system. Thereafter, fuel delivery is controlled according to the data from the oxygen sensor.

As illustrated in FIGS. 1 and 2, according to the prior art, the transfer of fuel control from the dynamic fuel control system to the oxygen sensor feedback fuel control system, illustrated as dashed line 100, involves a significant change in the amount of fuel delivered to the engine. That is, the prior art transfer of fuel control from lean dynamic crankshaft fuel control to normal oxygen sensor feedback fuel control involves a sudden increase in fuel delivery. This increase in delivered fuel causes an RPM surge and engine racing as shown in FIG. 2.

Advantageously, it has now been found that both dynamic crankshaft fuel control and oxygen sensor feedback fuel control use a proportional-integral-derivative calculation to determine the fuel multiplier which sets the amount of fuel delivered. As such, it would be desirable to use a component of the dynamic crankshaft fuel control proportional-integral-derivative calculation in the initial oxygen sensor feedback fuel control proportional-integral-derivative calculation to smooth the transfer from dynamic crankshaft fuel control to oxygen sensor feedback fuel control.

SUMMARY OF THE INVENTION

The above and other objects are provided by a method of controlling the delivery of fuel to an engine of an automotive vehicle equipped with a dynamic crankshaft fuel control system and an oxygen sensor feedback based fuel control system. The method includes determining an averaged combustion metric from the dynamic crankshaft fuel control system. The combustion metric is compared to an allowable engine roughness value and a dynamic crankshaft fuel control fuel multiplier is adjusted based on the comparison via a proportional-integral-derivative control calculation. Thereafter, the integral term of the dynamic crankshaft fuel control system's proportional-integral-derivative control calculation is stored. If it is time to switch fuel control from the dynamic crankshaft fuel control system to the oxygen sensor feedback fuel control system, the stored integral term of the dynamic crankshaft fuel control system's fueling multiplier is transferred to the proportional-integral-derivative calculation of the oxygen sensor feedback fuel control system. As such, the last integral term used in determining the fuel multiplier of the dynamic crankshaft fuel control system is used as the first integral term determining the fuel multiplier of in the oxygen sensor feedback fuel control system. As such, the transition from one fuel control system to the other is smoothed.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF THE PREFERRED EMBODIMENT

The present invention is directed towards a method of transferring fuel control from a dynamic crankshaft fuel control system to an oxygen sensor feedback based fuel control system. Advantageously, both dynamic crankshaft fuel control and oxygen sensor feedback fuel control use a proportional-integral-derivative calculation to determine a fuel multiplier for setting the amount of fuel delivered. By transferring the integral term of the dynamic crankshaft fuel control system's proportional-integral-derivative calculation to the initial proportional-integral-derivative calculation of the oxygen sensor feedback fuel control system, sudden increases in fuel delivery are avoided and RPM surges are eliminated. As such, a smooth fuel control transfer is achieved.

Figure 1:
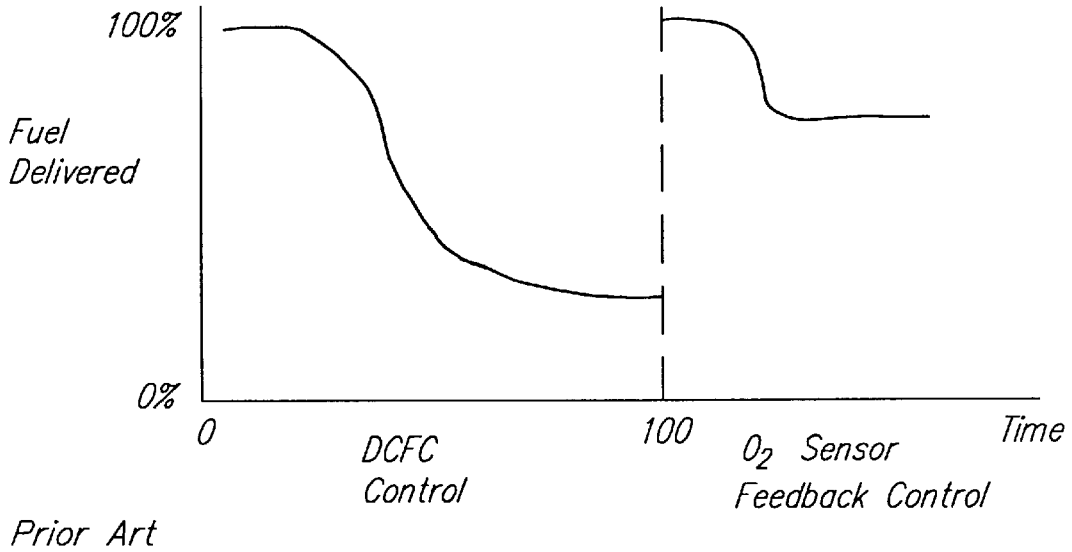
FIG. 1 is a graphical depiction of the change in fuel delivery over time as fuel control is transferred from dynamic crankshaft fuel control to oxygen sensor feedback fuel control according to the prior art.
Figure 2:
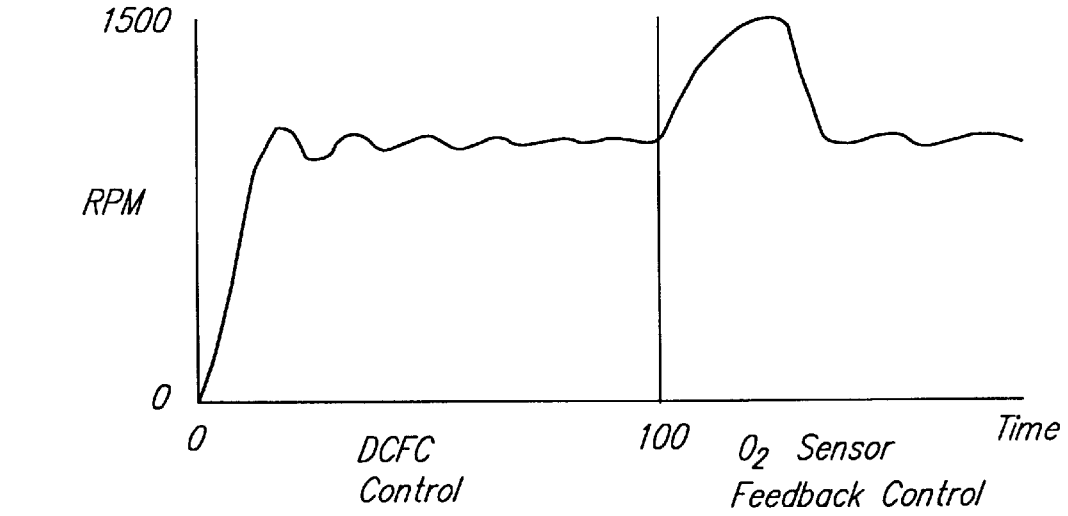
FIG. 2 is a graphical depiction of RPM fluctuations over time as fuel control is transferred from dynamic crankshaft fuel control to oxygen sensor feedback fuel control according to the prior art.
Figure 3:
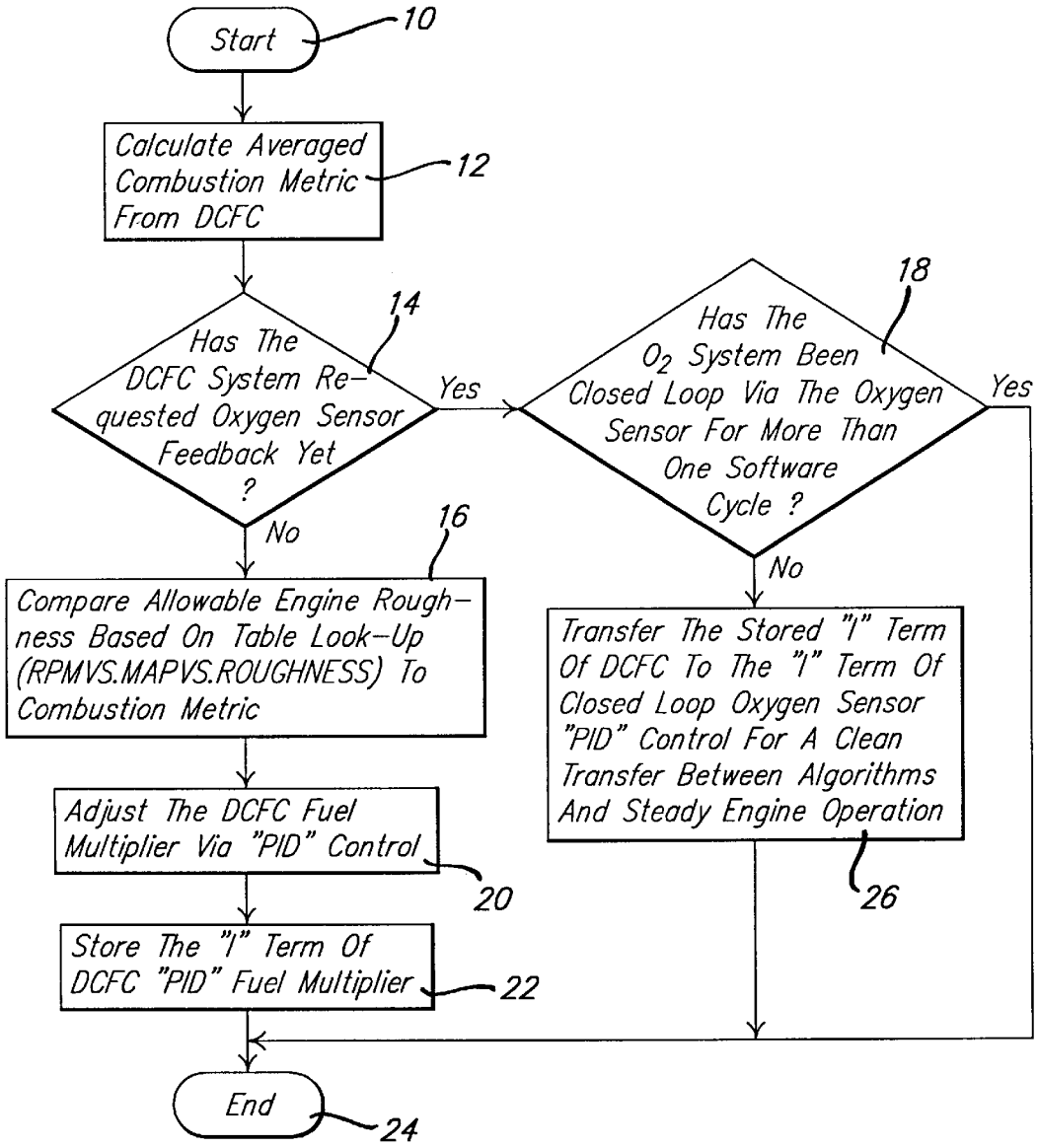
FIG. 3 is a flowchart depicting the methodology of transferring fuel control from dynamic crankshaft fuel control to oxygen sensor feedback fuel control system according to the present invention.

Turning now to the drawing figures, FIG. 3 depicts a flowchart of the methodology of the present invention. The methodology starts in bubble 10 and falls through to block 12. In block 12, the methodology calculates an averaged combustion metric from the dynamic crankshaft fuel control system. For a detailed description of the method for calculating such an averaged combustion metric, reference should be made to commonly assigned U.S. Pat. No. 5,809,969, entitled "Method for Processing Crankshaft Speed Fluctuations for Control Applications" issued Sep. 22, 1998, which is hereby expressly incorporated by reference herein. After calculating the averaged combustion metric in block 12, the methodology continues to decision block 14.

In decision block 14, the methodology determines whether fuel control has been transferred from the dynamic crankshaft fuel control system to the oxygen sensor fuel control system. This is determined by noting whether the operating system in which the present invention is employed has requested oxygen sensor feedback yet. If the system has not requested oxygen sensor feedback, fuel control remains with the dynamic crankshaft fuel control system. As such, the methodology advances to block 16. However, if the system has requested oxygen sensor feedback at decision block 14, fuel control has been transferred to the oxygen sensor feedback fuel control system. Thus, the methodology advances to decision block 18.

In block 16, the methodology performs normal dynamic crankshaft fuel control by comparing an allowable engine roughness value to the averaged combustion metric obtained in block 12. Preferably, the allowable engine roughness value is retrieved from a look-up table including RPM, manifold absolute pressure, and roughness as inputs. A more detailed description of the look-up table as well as the comparison step may be found in the above identified U.S. Pat. No. 5,809,969.

From block 16, the methodology advances to block 20 and adjusts the dynamic crankshaft fuel control system fuel multiplier via a proportional-integral-derivative calculation according to the difference between the allowable engine roughness value and averaged combustion metric obtained in block 16. From block 20, the methodology advances to block 22. In block 22, the methodology stores the integral term of the dynamic crankshaft fuel control system's proportional-integral-derivative determined fuel multiplier in a memory location. From block 22, the methodology continues to terminator 24 and exits the routine pending a subsequent execution thereof. For instance, the methodology could be executed periodically after each startup event until after fuel control is transferred to the oxygen sensor feedback fuel control system.

Referring again to decision block 18, if the operating system has requested oxygen sensor feedback in decision block 14, the methodology determines if the oxygen sensor feedback fuel control system has been operating in a closed loop mode for more than one software cycle. In this case, a closed loop mode means that the oxygen sensor feedback fuel control system has been operating based on oxygen sensor feedback alone and not on the transferred integral term from the dynamic crankshaft fuel control system as described below. If the oxygen sensor feedback fuel control system has been operating closed loop via the oxygen sensor for more than one software cycle, fuel control continues to be based on oxygen sensor feedback. Thus, the methodology advances to terminator 24 and exits the routine pending a subsequent execution thereof.

However, if the oxygen sensor feedback fuel control system has not been operating closed loop via oxygen sensor feedback for more than one software cycle in decision block 18, the methodology advances to block 26. In block 26, the stored integral term of the dynamic crankshaft fuel control system (block 22) is transferred to the integral portion of the proportional-integral-derivative control calculation of the oxygen sensor feedback fuel control system. As such, the initial fuel multiplier determined by the proportional-integral-derivative calculation of the oxygen sensor feedback fuel control system is based on the same integral term used in determining the last fuel multiplier of the dynamic crankshaft fuel control system. From block 26, the methodology continues to terminator 24 and exits the routine pending a subsequent execution thereof.

Figure 4:
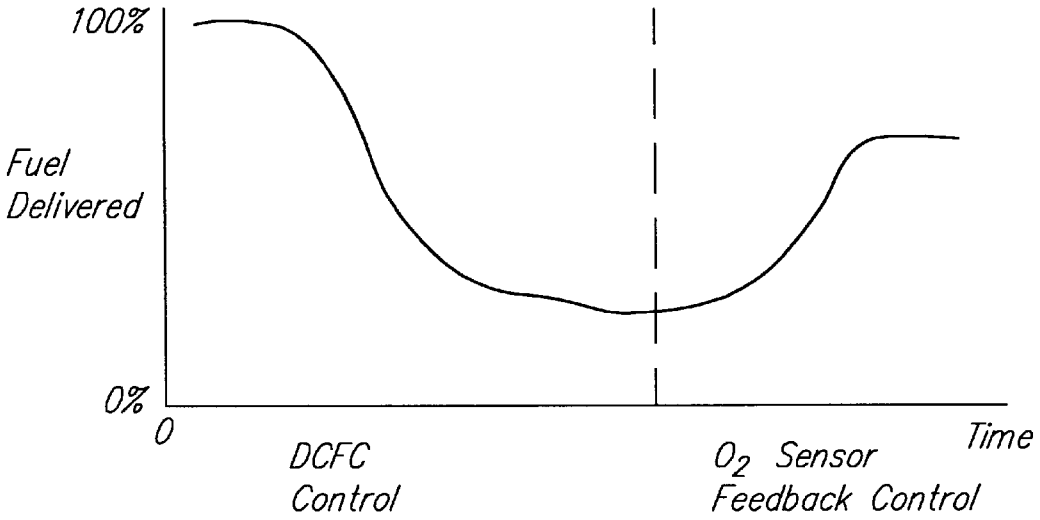
FIG. 4 is a graphical depiction of the change in fuel delivery over time as fuel control is transferred from dynamic crankshaft fuel control to oxygen sensor feedback fuel control according to the present invention.
Figure 5:
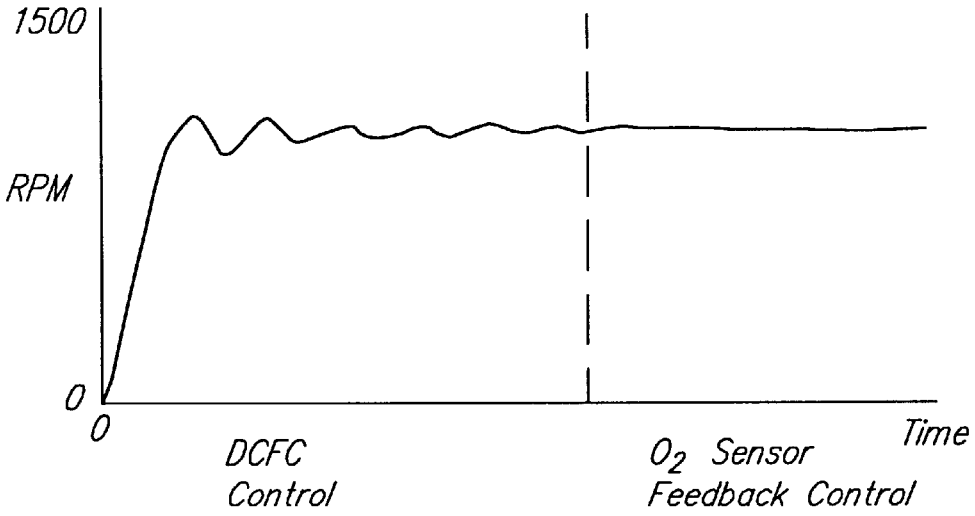
FIG. 5 is a graphical depiction of RPM fluctuations over time as fuel control is transferred from dynamic crankshaft fuel control to oxygen sensor feedback fuel control according to the present invention.

Referring now to FIGS. 4 and 5, according to the present invention, the transfer of the integral term from the dynamic crankshaft fuel control system's proportional-integral-derivative calculation to the proportional-integral-derivative calculation of the oxygen sensor feedback fuel control system smooths the change in fuel delivery over time. That is, at the transfer of fuel control from the dynamic crankshaft fuel control system to the oxygen sensor feedback fuel control system (depicted as dashed line 100) no sudden increase in fuel delivery occurs. As such, no RPM surge or engine racing occurs.

Thus, the present invention provides a method for smoothly transferring fuel control from a dynamic crankshaft fuel control system to an oxygen sensor feedback fuel control system. To accomplish this, at the time of fuel control transfer, the integral term of a proportional-integral-derivative fuel multiplier calculation of the dynamic crankshaft fuel control system is transferred as the integral term for the proportional-integral-derivative fuel multiplier calculation of the oxygen sensor feedback fuel control system. Accordingly, sudden increases in fuel delivery and attendant RPM surges associated with prior art fuel control transfer methods are eliminated.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. A method of controlling fuel delivery to an engine of an automotive vehicle equipped with a dynamic crankshaft fuel control system comprising:

obtaining a fuel multiplier from said dynamic crankshaft fuel control system via proportional-integral-derivative control;

storing an integral term of said fuel multiplier; and employing said integral term in a proportional-integral-derivative fueling multiplier calculation of an oxygen sensor feedback fuel control system.

2. The method of claim 1 wherein said fuel multiplier is based on a comparison of an averaged combustion metric and an allowable engine roughness value.

3. The method of claim 2 wherein said allowable engine roughness value is obtained from a look-up table.

4. The method of claim 3 wherein said look-up table includes RPM, manifold absolute pressure and engine roughness as inputs.

5. The method of claim 1 wherein said integral term is transferred from said dynamic crankshaft fuel control system to said oxygen sensor feedback fuel control system when fuel control is transferred to from said dynamic crankshaft fuel control system to said oxygen sensor feedback fuel control system.

6. The method of claim 5 wherein said integral term is only used in an initial execution of said proportional-integral-derivative calculation.

7. The method of claim 1 wherein said integral term is employed in said proportional-integral-derivative calculation of said oxygen sensor feedback fuel control system only if said oxygen sensor feedback fuel control system has not been operating closed loop based on oxygen sensor feedback alone for more than one software cycle.

8. A method of controlling a delivery of fuel to an engine of an automotive vehicle equipped with a dynamic crankshaft fuel control system and an oxygen sensor feedback fuel control system comprising:

determining an averaged combustion metric from said dynamic crankshaft fuel control system;

comparing said averaged combustion metric to an allowable engine roughness value;

adjusting a dynamic crankshaft fuel control fueling multiplier via a dynamic crankshaft fuel control proportional-integral-derivative fuel control calculation;

storing an integral term of said dynamic crankshaft fuel control proportional-integral-derivative fuel control calculation; and transferring said stored integral term to an integral portion of an oxygen sensor feedback fuel control proportional-integral-derivative fuel control calculation of said oxygen sensor feedback fuel control system.

9. The method of claim 8 wherein said step of transferring said stored integral term to said integral portion of said oxygen sensor feedback fuel control proportional-integral-derivative fuel control calculation of said oxygen sensor feedback fuel control system further comprises initially determining that fuel control has been transferred from said dynamic crankshaft fuel control system to said oxygen sensor feedback fuel control system.

10. The method of claim 9 wherein said step of initially determining that fuel control has been transferred from said dynamic crankshaft fuel control system to said oxygen sensor feedback fuel control system further comprises determining that oxygen sensor feedback has been requested.

11. The method of claim 8 wherein said step of transferring said stored integral term to said integral portion of said oxygen sensor feedback fuel control proportional-integral-derivative fuel control calculation of said oxygen sensor feedback fuel control system further comprises initially determining that said oxygen sensor feedback control system has not been closed loop via oxygen sensor feedback for more than one software cycle.

* * * * *